US009084444B2

(12) United States Patent
Lin et al.

(10) Patent No.: US 9,084,444 B2
(45) **Date of Patent: *Jul. 21, 2015**

(54) DISPOSABLE GLOVES AND GLOVE MATERIAL COMPOSITIONS

(75) Inventors: Ter-Hai Lin, Sugar Land, TX (US); Kevin Chung, Dickenson, TX (US); Jeff Teng, Houston, TX (US)

(73) Assignee: Inteplast Group, Ltd., Livingston, NJ (US)

( * ) Notice: Subject to any disclaimer, the term of this patent is extended or adjusted under 35 U.S.C. 154(b) by 195 days.

This patent is subject to a terminal disclaimer.

(21) Appl. No.: 13/113,773

(22) Filed: May 23, 2011

(65) Prior Publication Data

US 2011/0289653 A1 Dec. 1, 2011

Related U.S. Application Data

(60) Provisional application No. 61/348,060, filed on May 25, 2010.

(51) Int. Cl.
*A41D 19/00* (2006.01)

(52) U.S. Cl.
CPC ..... *A41D 19/0055* (2013.01); *A41D 2400/52* (2013.01)

(58) Field of Classification Search
CPC ..... A41D 19/0055; A41D 2400/52; A41D 19/0062; A41D 19/0068; A41D 19/0072
USPC ..... 2/159, 161.6, 161.7, 161.8, 167, 168; 428/35.7
See application file for complete search history.

(56) References Cited

U.S. PATENT DOCUMENTS

| | | | | |
|---|---|---|---|---|
| 3,151,333 | A | 10/1964 | Scholz | |
| 3,191,187 | A | 6/1965 | Comer et al. | |
| 3,739,400 | A | 6/1973 | Colehower | |
| 3,866,245 | A | 2/1975 | Sutherland | |
| 4,084,265 | A | 4/1978 | Anfelt | |
| 4,302,852 | A | 12/1981 | Joung | |
| 4,346,834 | A | 8/1982 | Mazumdar | |
| 4,783,857 | A | 11/1988 | Suzuki et al. | |
| 4,853,978 | A | 8/1989 | Stockum | |
| 5,008,125 | A | 4/1991 | Cale et al. | |
| 5,272,236 | A * | 12/1993 | Lai et al. | 526/348.5 |
| 5,272,771 | A | 12/1993 | Ansell et al. | |

(Continued)

FOREIGN PATENT DOCUMENTS

| | | | |
|---|---|---|---|
| CN | 201044775 | Y | 4/2008 |
| EP | 1260541 | A1 | 11/2002 |

(Continued)

OTHER PUBLICATIONS

Abstract of JP11350219; Dec. 21, 1999.

(Continued)

*Primary Examiner* — Alissa L Hoey
(74) *Attorney, Agent, or Firm* — Senniger Powers LLP

(57) ABSTRACT

A glove and glove construction material comprising two or more ethylene-based polymers which comprise (i) a first metallocene-linear low density polyethylene (m-LLDPE) and (ii) at least one ethylene-based polymer selected from the group consisting of a second metallocene-linear low density polyethylene (m-LLDPE), an ethylene-vinyl acetate copolymer (EVA), a linear low density polyethylene (LLDPE), and combinations thereof, plus optional additives.

20 Claims, 1 Drawing Sheet

(56) References Cited

U.S. PATENT DOCUMENTS

| | | | | |
|---|---|---|---|---|
| 5,451,439 | A * | 9/1995 | Bigg | 428/36.8 |
| 5,596,052 | A * | 1/1997 | Resconi et al. | 526/127 |
| 5,644,798 | A | 7/1997 | Shah | |
| 5,655,226 | A | 8/1997 | Williams | |
| 5,774,895 | A | 7/1998 | Baldwin | |
| 5,792,531 | A | 8/1998 | Littleton et al. | |
| 5,851,683 | A | 12/1998 | Plamthottam et al. | |
| 5,911,665 | A * | 6/1999 | Heydarpour et al. | 53/449 |
| 5,966,741 | A * | 10/1999 | Klecina | 2/169 |
| 6,016,570 | A * | 1/2000 | Vande Pol et al. | 2/161.7 |
| 6,017,997 | A * | 1/2000 | Snow et al. | 524/591 |
| 6,107,454 | A | 8/2000 | Schmieg et al. | |
| 6,124,428 | A * | 9/2000 | Schmieg et al. | 528/487 |
| 6,166,142 | A | 12/2000 | Zhang et al. | |
| 6,347,408 | B1 | 2/2002 | Yeh | |
| 6,355,733 | B1 | 3/2002 | Williams et al. | |
| 6,578,729 | B2 | 6/2003 | Grinberg | |
| 6,582,788 | B2 | 6/2003 | Yeh | |
| 6,638,587 | B1 | 10/2003 | Wang et al. | |
| 6,649,698 | B1 | 11/2003 | Mehta | |
| 6,670,412 | B1 | 12/2003 | Erderly et al. | |
| 6,846,530 | B2 | 1/2005 | Porter et al. | |
| 6,893,730 | B2 | 5/2005 | Moulton et al. | |
| 6,912,731 | B2 | 7/2005 | Cass | |
| 6,955,276 | B2 | 10/2005 | Grinberg | |
| 7,172,815 | B2 * | 2/2007 | Cook et al. | 428/516 |
| 7,971,276 | B2 | 7/2011 | Eng et al. | |
| 8,117,672 | B2 * | 2/2012 | Lipinski | 2/161.7 |
| 2003/0205847 | A1 | 11/2003 | Warneke et al. | |
| 2003/0226191 | A1 * | 12/2003 | Modha et al. | 2/161.7 |
| 2004/0182499 | A1 * | 9/2004 | Collier et al. | 156/164 |
| 2005/0204452 | A1 | 9/2005 | Yung | |
| 2006/0073297 | A1 * | 4/2006 | Glick et al. | 428/36.1 |
| 2006/0143767 | A1 * | 7/2006 | Yang et al. | 2/16 |
| 2006/0218697 | A1 | 10/2006 | Modha et al. | |
| 2006/0257674 | A1 * | 11/2006 | Lipinski et al. | 428/451 |
| 2006/0276594 | A1 * | 12/2006 | German et al. | 525/240 |
| 2007/0129496 | A1 * | 6/2007 | Shannon et al. | 525/240 |
| 2007/0148432 | A1 * | 6/2007 | Baker et al. | 428/304.4 |
| 2007/0160860 | A1 * | 7/2007 | Fiscus et al. | 428/516 |
| 2008/0045647 | A1 * | 2/2008 | Kwalk | 524/585 |
| 2008/0106005 | A1 * | 5/2008 | Fiscus et al. | 264/500 |
| 2008/0181969 | A1 * | 7/2008 | Blanton et al. | 424/618 |
| 2008/0235850 | A1 | 10/2008 | Cabauy et al. | |
| 2009/0298978 | A1 * | 12/2009 | Rotzinger | 524/130 |
| 2010/0035035 | A1 | 2/2010 | Defrang | |
| 2011/0030121 | A1 | 2/2011 | Smalls | |
| 2012/0047626 | A1 * | 3/2012 | Johnson | 2/161.6 |
| 2013/0067635 | A1 * | 3/2013 | Lin et al. | 2/161.6 |
| 2013/0067637 | A1 * | 3/2013 | Lin et al. | 2/167 |

FOREIGN PATENT DOCUMENTS

| | | | |
|---|---|---|---|
| EP | 1275664 | A1 | 1/2003 |
| EP | 1049751 | B1 | 12/2004 |
| JP | 11350219 | A | 12/1999 |
| KR | 300441719.0001 | | 3/2007 |
| WO | 97/44178 | A1 | 11/1997 |
| WO | 02/28965 | A1 | 4/2002 |
| WO | 02/094913 | A1 | 11/2002 |

OTHER PUBLICATIONS

Asian Hospital & Healthcare Management, "Medical Glove Manufacture—Going powder free", 4 pages, accessed on Feb. 29, 2012, <http://www.asianhhm.com/equipment_devices/gloves_powder_free.htm>.

Li et al., "Crystallization of partially miscible linear low-density polyethylene/poly(ethylene-co-vinylacetate) blends", Materials Letters, vol. 58, Issues 27-28, Nov. 2004, pp. 3613-3617.

Small et al., "The Characteristics of Polyethylene Film for Stretch and Cling Film Applications", Developments in Chemical Engineering and Mineral Processing, 2004, vol. 12, Issue 1-2, pp. 5-20.

Tomatsuri et al., "Metallocene Liner Low Density Polyethlene Blends for Pouch Materials in High-Speed Hot-Liquid Filing Process", Metallocene-catalyzed polymers: materials, properties, processing & markets, 1998, p. 323.

* cited by examiner

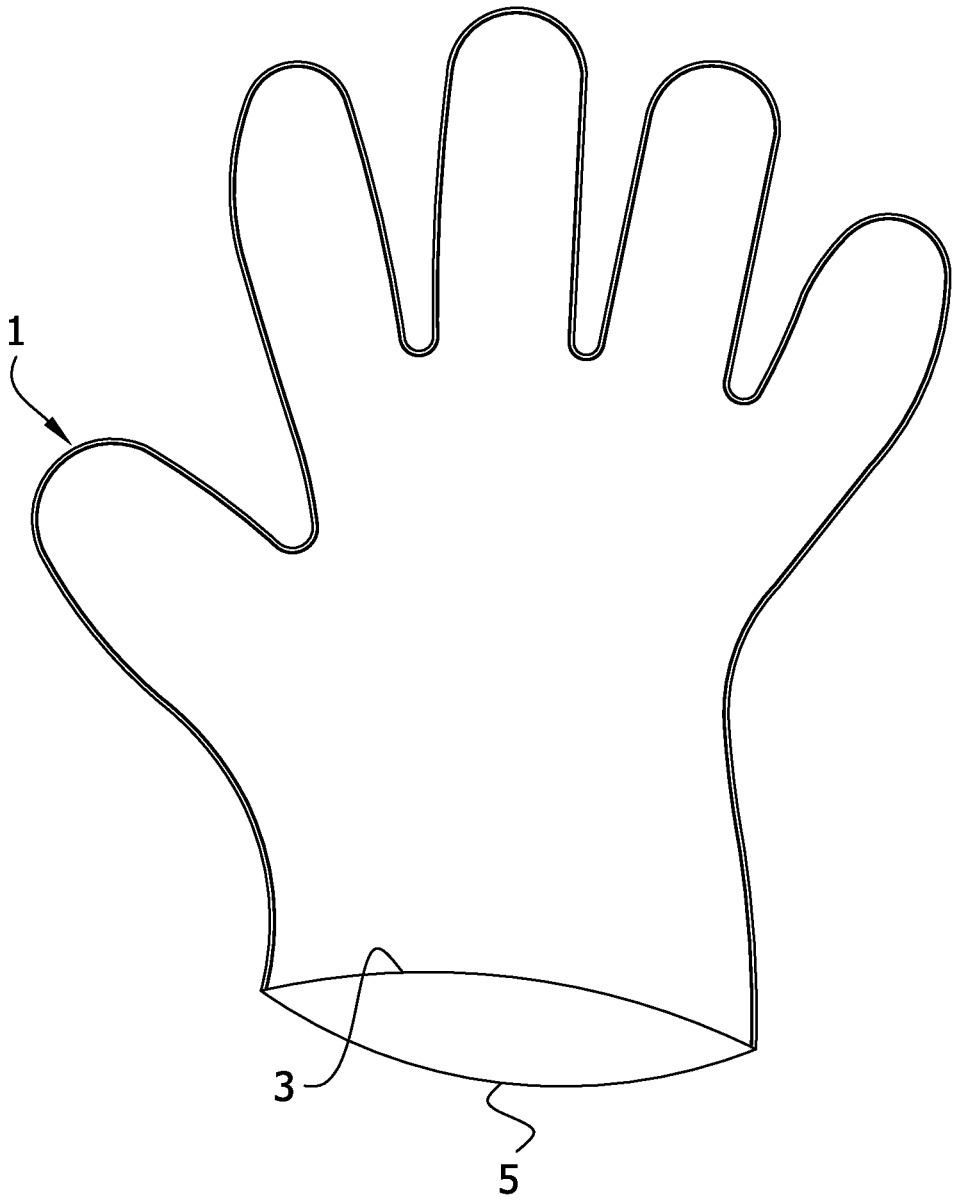
1
3
5

DISPOSABLE GLOVES AND GLOVE MATERIAL COMPOSITIONS

REFERENCE TO RELATED APPLICATIONS

This application claims priority to U.S. provisional application 61/348,060 filed May 25, 2010.

FIELD OF THE INVENTION

The present invention generally relates gloves and material for constructing gloves of thermoplastic materials comprising ethylene-based polymers and to articles manufactured using ethylene-based polymers.

BACKGROUND OF THE INVENTION

Disposable plastic gloves are manufactured according to high quality standards to protect hands and fingers from exposure to bacteria, viruses, and other contaminants commonly found in medical and hospital settings, food preparation areas, biologic engineering laboratories, electromechanical and manufacturing work, inspection industries, automotive repair, household, and so on. Gloves are also used to protect against contamination of, for example, pharmaceuticals and foods that may be handled.

Disposable plastic gloves are manufactured with several considerations in mind, such as:

1. materials costs,
2. environmental impact,
3. durability,
4. comfort,
5. sanitation,
6. ability to form a protective barrier, and
7. hypo- or non-allergenic materials.

Disposable gloves are conventionally manufactured from a mixture of polymers, typically a low density polyethylene and high density polyethylene, because of the low cost of the materials, the inertness of the materials to a wide range of chemicals, and the flexibility of the gloves over a wide range of temperatures. However, the materials used in the manufacture of disposable polyethylene gloves result in gloves that may not meet certain abovementioned requirements.

Gloves and other articles may be manufactured from different materials, such as vinyl, natural rubber latex, or synthetic latex. While each material provides certain advantages that render gloves made therefrom useful, each material also suffers certain disadvantages, as set forth in the following table.

| Plastics | Pro | Con |
|---|---|---|
| Polyethylene | Hypo-allergenic | Easy tear |
| | Excellent chemical resistance | Leakage at heat sealed seams |
| | Economical | Not as comfortable as Latex |
| | Low environmental impact | Poor dexterity |
| | Capable protective barrier | |
| Vinyl | Economical | Allergic reaction |
| | Good dexterity | Poor barrier capability |
| | Comfortable | Not as comfortable as latex |
| | | Environmental impact |
| Natural Rubber Latex | Capable protective barrier | Allergic reaction |
| | Comfortable | Chemical resistance |
| | Excellent dexterity | Environmental impact |
| Synthetic Latex | Excellent Barrier capability | Allergic reaction |
| | Durable | Environmental impact |
| | Excellent dexterity | Not as comfortable as latex |
| | High cost | |

SUMMARY OF THE INVENTION

The present invention is directed to a thermoplastic material comprising two or more ethylene-based polymers. The two or more ethylene-based polymers comprise (i) a first metallocene-linear low density polyethylene (m-LLDPE) and (ii) at least one ethylene-based polymer selected from the group consisting of a second metallocene-linear low density polyethylene (m-LLDPE), an ethylene-vinyl acetate copolymer (EVA), a linear low density polyethylene (LLDPE), and combinations thereof. The thermoplastic elastomer is characterized by tensile strength at yield (MD) of no more than about 14 MPa (about 2000 psi) (e.g., no more than 14 MPa (2000 psi)), tensile strength at yield (TD) of no more than about 14 MPa (about 2000 psi) (e.g., no more than 14 MPa (2000 psi)), tensile elongation at break (MD) of at least about 500% (e.g., at least 500%), and tensile elongation at break (TD) of at least about 700% (e.g., at least 700%).

The present invention is further directed to a glove comprising a glove construction material in the shape of a glove and adapted for receiving thumb, fingers and a hand therein and comprising a thermoplastic material blend comprising two or more ethylene-based polymers. The two or more ethylene-based polymers comprise (i) a first metallocene-linear low density polyethylene (m-LLDPE) and (ii) at least one ethylene-based polymer selected from the group consisting of a second metallocene-linear low density polyethylene (m-LLDPE), an ethylene-vinyl acetate copolymer (EVA), a linear low density polyethylene (LLDPE), and combinations thereof. The thermoplastic elastomer is characterized by tensile strength at yield (MD) of no more than about 14 MPa (about 2000 psi), tensile strength at yield (TD) of no more than about 14 MPa (about 2000 psi), tensile elongation at break (MD) of at least about 500%, and tensile elongation at break (TD) of at least about 700%.

Other objects and features will be in part apparent and in part pointed out hereinafter.

BRIEF DESCRIPTION OF THE DRAWINGS

FIG. 1 depicts a perspective view of the glove comprising two films of thermoplastic material.

DESCRIPTION OF THE EMBODIMENT(S) OF THE INVENTION

The present invention is directed to a thermoplastic material comprising two or more ethylene-based polymers. The thermoplastic material may be formulated into a thin film. The film manufactured from the thermoplastic material of the preset invention is characterized by significantly improved toughness, tear strength, and heat seal strength compared to conventional polyolefin films known in the art.

In another aspect, the present invention is directed to articles manufactured using the film of the present invention. For example, disposable gloves and other related protective coverings may be manufactured using the film of the present invention. The gloves are manufactured using a soft and stretchy formulation that offers a product which meets the desired properties for a glove that will come into contact with and protect human skin. Industrial uses for these gloves include, for example, the automotive and the healthcare industries.

Given the economy of heat sealing compared to other methods of making gloves, a preferred method of manufacture of disposable gloves is by heat sealing. In another aspect, therefore, the present invention is directed to a method of manufacturing the film into an article, the method comprising heat sealing two layers of film. In one preferred embodiment, two layers of film are heat sealed and die cut into a multi-layer article, for example, disposable plastic gloves. Accordingly, there is provided an improved article, e.g., plastic glove as shown at 1 in FIG. 1, comprising two films 3 and 5 of thin thermoplastic material of the present invention bonded to one another along a seal line conforming generally to the required finger and hand outline of the required glove. In general, the method of manufacture comprises folding a film double as it is drawn off the roll, with the line of the fold in the machine direction, then passing the double layer of plastic into a reciprocating heat seal and cut out die, where the glove seams are made and the glove is cut out, all in one single, rapid motion.

The present invention comprises a film prepared from a thermoplastic material comprising ethylene-based polymers. As a general matter, the thermoplastic material comprises a high performance, conventional or single-site metallocene-linear low density polyethylene (m-LLDPE) and one or more additional ethylene-based polymers selected from a second metallocene-linear low density polyethylene (m-LLDPE), an ethylene-vinyl acetate copolymer (EVA), a linear low density polyethylene (LLDPE), or any combination thereof, plus optional additives.

The thermoplastic material comprising a high performance, conventional or single-site metallocene-linear low density polyethylene (m-LLDPE) and one or more additional ethylene-based polymers selected from a second metallocene-linear low density polyethylene (m-LLDPE), an ethylene-vinyl acetate copolymer (EVA), a linear low density polyethylene (LLDPE), or any combination thereof has the properties of a thermoplastic elastomer. A thermoplastic elastomer, in the context of the present invention, denotes a low modulus, highly flexible, and highly elastic material comprising two or more ethylene-based polymers in such intimate contact so as to form reversible, non-covalent cross-links such as by hydrogen bonding, dipole, or van der Waal's interactions. Intimate mixing of the two or more polymers may be accomplished by means known in the art, for example, injection molding, extrusion, and blow molding.

In some embodiments, the thermoplastic material comprises a metallocene-linear low density polyethylene (m-LLDPE) and an ethylene-vinyl acetate copolymer (EVA). In some embodiments, the thermoplastic material comprises a combination of a metallocene-linear low density polyethylene (m-LLDPE) and a linear low density polyethylene (LLDPE). In some embodiments, the thermoplastic material comprises a combination of a first metallocene-linear low density polyethylene (m-LLDPE) and a second metallocene-linear low density polyethylene (m-LLDPE). In some embodiments, the thermoplastic material comprises a combination of a first metallocene-linear low density polyethylene (m-LLDPE), a second metallocene-linear low density polyethylene (m-LLDPE), and an ethylene-vinyl acetate copolymer (EVA). In some embodiments, the thermoplastic material comprises a combination of a first metallocene-linear low density polyethylene (m-LLDPE), a second metallocene-linear low density polyethylene (m-LLDPE), and a linear low density polyethylene (LLDPE). In some embodiments, the thermoplastic material comprises a combination of a metallocene-linear low density polyethylene (m-LLDPE), an ethylene-vinyl acetate copolymer (EVA), and a linear low density polyethylene (LLDPE). In some embodiments, the thermoplastic material comprises a combination of a first metallocene-linear low density polyethylene (m-LLDPE), a second metallocene-linear low density polyethylene (m-LLDPE), an ethylene-vinyl acetate copolymer (EVA), and a linear low density polyethylene (LLDPE).

It has been surprisingly found that the thermoplastic material comprising two or more ethylene-based polymers not only gives the excellent heat seal strength and lower heat seal temperature but also offer the film with toughness, tear strength, and excellent dexterity which will offer better functionality than conventional disposable polyolefin films.

In some embodiments, the thermoplastic material comprising two or more ethylene-based polymers comprises a high performance, conventional or single-site metallocene-linear low density polyethylene (m-LLDPE). M-LLDPE is so-named due to the metallocene catalyst that catalyzes the polymerization of ethylene. The m-LLDPE has a density within the range of about 0.86 grams per cubic centimeter to about 0.92 grams per cubic centimeter, such as between about 0.87 grams per cubic centimeter to about 0.905 grams per cubic centimeter. Density may be measured by ASTM D792. The m-LLDPE has a melt index (MI) within the range of about 1.0 dg/min to about 5.0 dg/min, such as between about 1.0 dg/min to about 2.0 dg/min. The method for determining the melt index is described in the standards ASTM D1238 and ISO 1133.

M-LLDPE polymers provide excellent tear strength, toughness, and elasticity. Elasticity in the thermoplastics field is generally determined by a combination of tensile strength at yield and tensile elongation at break. In the context of the present invention, the thermoplastic material is characterized by low tensile strength at yield and high tensile elongation at break. Yield point is the point on the stress-strain curve, where the slope of the curve becomes zero. Tensile strength at yield reflects the stress at this point in the stress-strain curve. Tensile strength at yield may be measured at both the machine direction (MD) orientation and the transverse direction (TD) orientation. Break point is the point at which the material ruptures. Tensile elongation at break is the percentage increase in length before it breaks under tension. Tensile elongation may be measured at both the machine direction (MD) orientation and the transverse direction (TD) orientation. Both quantities are measured according to the standard set forth in ASTM D882. Metallocene-LLDPE having densities near or below about 0.9 g/cm$^3$ are preferred since they tend to provide excellent elastic recovery in terms of low tensile strength at yield and high tensile elongation at break. That is, it is preferred to prepare the thermoplastic material of the present invention with an elastomeric m-LLDPE since the elastic recovery property is a distinct advantage of this component of the combination to the elasticity of the final resultant thermoplastic elastomer.

The thermoplastic material of the present invention preferably comprises a relatively low density m-LLDPE having a tensile strength at yield (MD) that is no more than about 14 MPa (about 2000 psi), no more than about 10 MPa (about 1450 psi), or even no more than about 8.5 MPa (about 1200 psi). Preferably, the tensile strength at yield (TD) is no more than about 14 MPa (about 2000 psi), no more than about 10 MPa (about 1450 psi), or even no more than about 6.9 MPa (about 1000 psi).

Preferably, the tensile elongation (MD) at break is at least 400%, at least 500%, or at least 600%. Preferably, the tensile elongation (TD) at break is at least 400%, at least 500%, or at least 600%.

Preferred m-LLDPE polymers excellent tear strength, as measured by the Elmendorf test method ASTM D 1922 (2 mil/50 micrometer sample) in both the machine direction (MD) orientation and the transverse direction (TD) orientation. Preferably, the tear strength (MD) is at least 350 grams, at least about 450 grams, or even at least about 500 grams. Preferably, the tear strength (TD) is at least about 500 grams, at least about 600 grams, or even at least at least about 700 grams.

Toughness may be measured by the Dart Impact, ASTM D1709 standard (2 mil/50 micrometer sample). Falling dart impact is a traditional method for evaluating the impact strength or toughness of a plastic film. This test uses a single dart configuration and a single drop height, while varying the weight of the dart. Preferably, the toughness of the m-LLDPE as measured by the falling dart impact is at least about 700 grams, or even at least about 800 grams.

The thermoplastic material comprising two or more ethylene-based polymers generally comprises between about 30 wt. % and about 75 wt. % of the m-LLPDE component, such as between about 35 wt. % and about 65 wt. %, or even between about 55 wt. % and about 65 wt. %. In some embodiments, the thermoplastic material generally comprises between about 30 wt. % and about 50 wt. % m-LLDPE polymer.

M-LLDPE polymers are available commercially, such as Exact™ 4049 LLDPE polymers available from Exxon Mobil Chemical, AFFINITY PL series, e.g., 1880G and 1881G, from The Dow Chemical Company.

In some embodiments, the thermoplastic material of the invention comprises a copolymer comprising ethylene and vinyl acetate repeat units. In general, the weight percent of the vinyl acetate repeat units in the ethylene-vinyl acetate (EVA) copolymer weight percent may range from about 5 wt. % to about 40 wt. %, preferably between about 9 wt. % and about 20 wt. %, the balance being ethylene. In some embodiments, the VA content may be higher, such as between about 25 wt. % and about 40 wt. %, such as between about 30 wt. % and about 35 wt. %. In general, the EVA copolymer has a density from about 0.920 grams per cubic centimeter to about 0.950 grams per cubic centimeter, such as from about 0.930 grams per cubic centimeter to about 0.940 grams per cubic centimeter. Density may be measured by ASTM D1505. The EVA copolymer has a melt index (MI) from about 1.0 dg/min to about 5.0 dg/min. The melt index may be measured by ASTM D1238.

EVA copolymers provide excellent processability, low temperature sealing, and chemical resistance. Advantageously, EVA copolymers are very elastic, as measured by tensile strength at yield and tensile elongation at break, both under the ASTM D638 standard. The EVA copolymer may have a tensile strength at yield (ASTM D638) of less than about 80 kg/cm$^2$ (about 8 MPa), less than about 70 kg/cm$^2$ (about 7 MPa), or even less than 50 kg/cm$^2$ (about 5 MPa). Preferably, the EVA polymer is characterized by tensile elongation at break (ASTM D638), which may be at least 600%, at least 700%, or even at least 800%. The EVA co-polymer is therefore an advantageous component of the thermoplastic material due to its excellent elastomeric properties, as measured by low tensile strength at yield and high elongation at break. Therefore, it is preferred to prepare the thermoplastic elastomer material of the present invention with an elastomeric EVA copolymer since the elastic recovery property is a distinct advantage of this component to the elasticity of the final resultant thermoplastic elastomer.

The thermoplastic material of this embodiment generally comprises between about 30 wt. % and about 70 wt. % EVA copolymer, more preferably between about 30 wt. % and about 50 wt. % EVA copolymer.

EVA copolymers are available commercially, such as TAISOX® EVA copolymers, available from Formosa Plastics Corporation, ELVAX® EVA copolymers, available from DuPont, and Tritheva® EVA copolymers, available from Petroquimica Triunfo.

In some embodiments, the thermoplastic material of the present invention comprises a linear low density polyethylene (LLDPE). Linear low-density polyethylene (LLDPE) is a substantially linear polymer (polyethylene), with significant numbers of short branches, commonly made by copolymerization of ethylene with longer-chain olefins, such as butene, hexene, or octene. Preferred LLDPE polymer comprise ethylene-based polymer copolymerized with butene. The LLDPE in one embodiment has a density within the range of about 0.83 grams per cubic centimeter to about 0.925 grams per cubic centimeter, such as between about 0.85 grams per cubic centimeter to about 0.90 grams per cubic centimeter. In a currently preferred embodiment, the LLDPE has a density within the range of about 0.83 grams per cubic centimeter to about 1.0 grams per cubic centimeter, such as between about 0.915 grams per cubic centimeter to about 0.935 grams per cubic centimeter. Density may be measured by ASTM D1505. The LLDPE has an MI within the range of about 0.25 dg/min to about 2.0 dg/min, such as between about 0.45 dg/min to about 1.0 dg/min, and between about 0.5 and 2.0 dg/min in a currently preferred embodiment. The melt index may be measured by ASTM D1238.

LLDPE polymers are chosen to enhance the toughness, tear strength, and stretchability of the thermoplastic material. LLDPE polymers are characterized by tensile elongation (MD) at break is at least 300%, at least 400%, or at least 500%. Preferably, the tensile elongation (TD) at break is at least 500%, at least 600%, or at least 700%. LLDPE polymers are additionally an economical additive. In some embodiments, the thermoplastic material generally comprises between about 10 wt. % and about 30 wt. % LLDPE polymer.

LLDPE polymers are available commercially, such as the Formolene L42099 polymers available from Formosa Plastics.

Among the optional additional components are included antiblock, slip, UV inhibitors, colorants, and fillers, and others as are known in the plastic film industry. While polyolefins are generally self-lubricating, slip and antiblock additives are generally added to polyolefin materials for film blowing applications.

A slip additive is a plastics modifier that acts as a lubricant by exuding to the surface of the plastic during and immediately after processing to reduce friction between layers of film. Lower friction facilitates handling of the film and other surfaces, e.g., rollers, to which the film comes into contact. Slip additives are generally fatty materials, such as, for example, long chain fatty acids, alcohols, and amides. Preferred slip additives are fatty amides having carbon chains generally ranging from 14 to 22 carbon atoms, such as from 15 to 19 carbon atoms, including oleamide and stearic amide.

An antiblock additive is a plastics modifier that is generally added to prevent blocking, which occurs when two adjacent layers of film adhere together when pressed together, such as during windup on a roll or film stacking. Antiblock additives are added to form micro-bumps on the surface of a plastic film, which minimizes film to film contact. Antiblock additives may be inorganic materials, such as natural silica particles, talc, synthetic silica, calcium carbonate, ceramic spheres, kaolin/clay, and mica. Organic antiblock additives include ethylene bisstearamide, stearyl erucamide, stearamide, erucamide, glycerol monostearate, zinc stearate, silicone, and PTFE.

The thermoplastic material of the present invention may comprise between about 1 wt. % and about 10 wt. % of an optional additional component, such as between about 5 wt. % and about 10 wt. % of an optional additional component. Preferably, the thermoplastic material comprises both anti-block and slip additives. Accordingly, the thermoplastic material preferably comprises between about 1 wt. % and about 10 wt. %, such as between about 5 wt. % and about 10 wt. % of an anti-block additive. The thermoplastic material preferably comprises between about 1 wt. % and about 10 wt. %, such as between about 5 wt. % and about 10 wt. % of a slip additive.

In one preferred embodiment, the thermoplastic material comprises between about 30 wt. % to about 70 wt. % m-LLDPE and between about 30 wt. % to about 70 wt. % of the EVA copolymer. The thermoplastic material may comprise between about 5 wt. % and about 10 wt. % of an anti-block additive. The thermoplastic material may comprise between about 5 wt. % and about 10 wt. % of a slip additive.

In one preferred embodiment, the thermoplastic elastomer comprises about 40 wt. % m-LLDPE and about 40 wt. % of the EVA copolymer, the balance being optional additives such as anti-block and slip additives, such as between about 5 wt. % and about 10 wt. % of an anti-block additive and between about 5 wt. % and about 10 wt. % of a slip additive.

In another preferred embodiment the thermoplastic material comprises between about 35 wt. % and about 65 wt. % m-LLDPE, and between about 15 and about 45 wt. % LLDPE. The thermoplastic material may comprise between about 5 wt. % and about 10 wt. % of an anti-block additive. The thermoplastic material may comprise between about 5 wt. % and about 10 wt. % of a slip additive.

In another preferred embodiment, the thermoplastic elastomer comprises between about 30 wt. % and about 55 wt. % of a first m-LLDPE, between about 30 wt. % and about 55 wt. % of a second m-LLDPE. The thermoplastic material may comprise between about 5 wt. % and about 10 wt. % of an anti-block additive. The thermoplastic material may comprise between about 5 wt. % and about 10 wt. % of a slip additive.

In another preferred embodiment, the thermoplastic elastomer comprises between about 30 wt. % to about 50 wt. % of the EVA copolymer, between about 10 wt. % and about 30 wt. % LLDPE, and between about 30 wt. % and about 50 wt. % m-LLDPE. The thermoplastic material may comprise between about 5 wt. % and about 10 wt. % of an anti-block additive. The thermoplastic material may comprise between about 5 wt. % and about 10 wt. % of a slip additive.

In one aspect, the thermoplastic material of the invention comprises the components and optional additives described herein in that the formulation is open to additional compatible additives not described herein. It is not practical to presently envision and describe all potential independent additives such as perfumes, dyes, etc. The list is nearly endless considering the variety of potential functionalities. In alternative embodiments, the material of the invention consists essentially of the components and optional additives described herein in that non-recited components that would materially affect the basic and novel properties are excluded. And in further alternatives, the material of the invention more strictly consists of the recited components and optional additives. Along these lines, certain embodiments of the invention expressly limit and others expressly exclude the presence of, independently, vinyl, HDPE, latex, and/or nitrile. For example, in some embodiments the content of one or more of these is strictly limited to no more than 5 wt % (e.g., up to 5% HDPE, or up to 5% HDPE and 5% vinyl), or even no more than 2 wt % or 1 wt %. Other embodiments are essentially or alternatively absolutely, HDPE-free, latex-free, vinyl-free, or nitrile-free. Other embodiments are essentially or alternatively absolutely HDPE-free, latex-free, vinyl-free, and nitrile-free.

The present invention is further directed to a method of preparing a thin film from the thermoplastic elastomer of the present invention. The film is then further processed into an article useful as a protective covering for human skin, for example, disposable gloves. The gloves may be manufactured via processes such as casting into lightweight films (Cast film) or being blown into lightweight films (blown films). In general, two sheets of film prepared from the thermoplastic elastomer of the present invention are seamed and heat sealed to form gloves. Advantageously, the gloves may be non-powdered.

In preparing the film comprising the thermoplastic elastomer, the process comprises a first step of combining all component polymers and optional additives in a continuous gravimetric blender which has several compartments for individual components. The components at all compartments are continuously fed and mixed into the blender according to the desired percentage weight which is controlled by load cells. Blenders for this process are commercially available, for example, from K-Tron Process Group or Foremost Machine.

The components are blended through the continuous gravimetric blender which has several individual compartments depending on the formulation and process requirement. Through gravity conveying, the blender provides a precise homogenous blend of materials. Process controls are determined at the time of blending and generally depend upon the mass of material added, the relative weight percent of each component, and the blender.

The blended compound is loaded into extruder hopper. The blended material in the hopper is gravimetrically conveyed into the feeding zone of the extruder.

The heart of the extrusion process is an extruder which consists of a screw and a die head (spiral mandrel). The extruder is essentially a machine used to melt the plastic and deliver the melted plastic under pressure to a die. Typically, extrusion begins with granular material, gravity-fed via a hopper to a rotary screw. The screw is a raised flighted helix that traps material and moves it forward through an enclosed, heated barrel where it is first melted, and then pressurized. The extruder accomplishes solids conveying, melting or plasticating, mixing, melt conveying, degassing, and shaping or forming by, for example, an extruder die.

The blended thermoplastic material is then extruded through a casting or blown die to convert the molten plastics into a thin film, the thin film having a thickness of at least about 12 micrometers (at least about 0.5 mil) and a surface area of at least about 25 $cm^2$, although typically, the surface area of the film is much larger, i.e., on the order of hundreds or even thousands of $cm^2$. The optimum set of operating conditions can be determined through experience with a particular extruder. Optimum running conditions require the proper balancing of many variables such as:

- Screw design including pump ratio, compressional ratio, Flight depth, Flight height, etc.
- Extruder size: L/D
- Extrusion rate
- Extruder conditions (temperatures, pressures, clearances, surface roughness, etc.)
- Formulation The film thickness is controlled by the speed of a take-away roll. The take-away speed may be adjusted to fine-tune the sheet thickness. The finished film gauge is typically at least about 12 micrometers (at least about 0.5 mil), and generally vary from about 20 micrometers and about 200 micrometers (between about 0.8 mil and about 8 mil), such as from about 25 micrometers and about 50 micrometers (between about 1 mil and about 2 mil). The density of the thermoplastic material is generally less than about 0.925 g/cm$^3$ and in some embodiments may be less than about 0.91 g/cm$^3$, or even less than about 0.90 g/cm$^3$. The film gradually cools down through a series of leading rolls which may have temperature control to reduce the film temperature to the ambient temperature before winding. The film may be rolled into a master roll prior to the article manufacture process (e.g., fold, cut, and seal process for manufacturing disposable gloves).

For casting the film into an article, the extruded thin film is then folded double as it is drawn off the roll, with the line of the fold in the machine direction. The double layer of plastic is then passed into a reciprocating heat seal and cut out die, where the seams of the article are defined to thereby define an article, e.g., a glove, having a surface area of at least about 25 cm$^2$. The article is heat sealed and cut out, all in one single, rapid motion. The article is in the shape of a glove and adapted for receiving thumb, fingers and a hand therein. For blown film, the film bubble can be directly heat sealed and die cut off without the folding process.

Heat sealing is the thermal fusion of two (or more) melt-bond compatible thermoplastic materials. All heat seals require the precise control of heat, time, and pressure to create a quality weld. These process controls are determined at the time of sealing. In general, the seal temperature for preparing an article, e.g., a disposable glove, is generally less than 100° C., such as between about 80° C. and 90° C., which compares favorably to the seal temperatures of conventional polyolefin films employing high density polyethylene, which are generally above 125° C. Thermal Impulse heat sealing is the process of welding thermoplastic films together by means of a resistance ribbon(s) through a cycle of heating and cooling under pressure. By controlling the rate of heating and cooling, superior welds are created without sacrificing the physical property values of the original film. Thermal impulse techniques are used to make bags, lay flat tubing, medical packaging, large panels, and protective garments.

The thermoplastic material of the present invention combines the prominent advantages of latex, high density polyethylene (HDPE), and vinyl. The thermoplastic materials of the present invention are further advantageous since they are easier to prepare than materials made from latex, HDPE, and vinyl. For example, compared to processes for preparing articles such as disposable gloves from HDPE, the process for preparing articles using the thermoplastic material of the present invention have shorter cycle time and lower seal temperature. Articles manufactured from latex, vinyl, and nitrile are manufactured by the dipping mold process, which is substantially slower than the heat-seal-die cut method for preparing articles from the thermoplastic material of the present invention.

As can be seen by the below examples, the thermoplastic material of the present invention, which are manufactured from two or more ethylene-based polymers, yield articles having mechanical properties such as dexterity and tear strength that are much better than polyethylene articles currently on the market. For example, articles, such as disposable gloves, manufactured from films prepared from thermoplastic elastomer of the present invention are particularly elastic, having tensile strength at yield (MD) of no more than about 10 MPa (about 1450 psi), tensile strength at yield (TD) of no more than about 10 MPa (about 1450 psi), tensile elongation at break (MD) of at least about 500%, and tensile elongation at break (TD) of at least about 700%.

Preferably, the tensile strength at yield (MD) is no more than about 14 MPa (about 2000 psi), no more than about 10 MPa (about 1450 psi), or even no more than about 6.9 MPa (about 1000 psi), such as between about 4.2 MPa (about 600 psi) and 14 MPa (about 2000 psi). Preferably, the tensile strength at yield (TD) is no more than about 14 MPa (about 2000 psi), no more than about 10 MPa (about 1450 psi), or even no more than about 6.9 MPa (about 1000 psi), such as between about 4.2 MPa (about 610 psi) and 14 MPa (about 2000 psi). The tensile strength at yield may be measured by ASTM D882.

The tensile elongation at break (MD) may be at least about 500%, at least about 600%, at least about 700%, or even at least about 800%. The tensile elongation at break (TD) may be at least about 700%, at least about 800%, at least about 900%, or even at least about 1000%. Tensile elongation at break is measured by ASTM D882.

The thermoplastic material of the present invention is further characterized by better tear strength than conventional polyolefin films. In this regard, the tear strength (MD) is generally at least about 1.6 g/micrometer (about 40 g/mil), at least about 2.0 g/micrometer (about 50 g/mil), at least about 2.4 g/micrometer (about 60 g/mil), or even at least about 2.8 g/micrometer (about 70 g/mil), according to ASTM D1922. In some embodiments, the tear strength (MD) is between about 2.0 g/micrometer (about 50 g/mil) and about 3.1 g/micrometer (about 80 g/mil).

Additionally, since they are made from polyethylene materials, the thermoplastic elastomers are non-allergenic, environmentally-friendly, and more economical than articles manufactured from latex, vinyl, and nitrile.

Having described the invention in detail, it will be apparent that modifications and variations are possible without departing from the scope of the invention defined in the appended claims.

EXAMPLES

The following non-limiting examples are provided to further illustrate the present invention.

Each example was below was prepared according to the above-described process and pressed into a disposable glove.

Example 1

Thermoplastic Elastomer of the Invention

A thermoplastic elastomer according to the present invention was prepared comprising the following components and concentrations in wt. %:

40 wt. % ethylene-vinyl acetate copolymer (EVA, TAISOX® available from Formosa Plastics Corporation, Polyolefin Divisions);

40 wt. % metallocene-linear low density polyethylene (m-LLDPE, Exact™4049 available from ExxonMobil Chemical);

10 wt. % slip additive (oleamide); and 10 wt. % antiblock additive (synthetic silica)

The above-described components were blended and extruded as a thin film, folded, heat sealed, and cut into a disposable glove. The disposable glove prepared from the above-described combination was subjected to various standard tests and compared to a commercially available glove ("PE glove" in the Tables) made from a combination of linear low density polyethylene and high density polyethylene and a commercially available vinyl glove. The results of those tests are shown below in Tables 1A (International System Units) and 1B (US Customary/Imperial Units).

TABLE 1A

International System Units

| Composition | Example 1 Combination | | PE | Vinyl | Test |
|---|---|---|---|---|---|
| Test Item | Unit | Value | glove | Glove | Method |
| Gauge (Calculated) | μm | 32.37 | 10.00 | 50.00 | |
| Density | g/cm$^3$ | 0.9084 | 0.945 | 1.25 | |
| Tensile Strength at Yield (MD) | MPa | 5.4 | 23.7 | 6.7 | ASTM D882 |
| Tensile Strength at Yield (TD) | MPa | 7.5 | N/A | 5.3 | ASTM D882 |
| Tensile Strength at break (MD) | MPa | 20.7 | 40.4 | 12.4 | ASTM D882 |
| Tensile Strength at break (TD) | MPa | 18.5 | 25.2 | 9.7 | ASTM D882 |
| Tensile Elongation at Break (MD) | % | 631 | 290 | 600 | ASTM D882 |
| Tensile Elongation at Break (TD) | % | 1027 | 590 | 295 | ASTM D882 |
| Tear Strength (MD) | grams/μm | 2.52 | 0.23 | 12.6 | ASTM D1922 |
| Tear Strength (TD) | grams/μm | 8.86 | 10.6 | 13.6 | ASTM D1922 |
| Dart Impact | grams/μm | 13.13 | <10 | NA | ASTM D1709 |
| Seal Temperature | ° C. | 80-90 | 125-130 | NA | |

TABLE 1B

U.S. Customary/Imperial Units

| Composition | Example 1 Combination | | PE | Vinyl | Test |
|---|---|---|---|---|---|
| Test Item | Unit | Value | glove | Glove | Method |
| Gauge (Calculated) | mil | 1.3 | 0.40 | 2 | |
| Density | oz/in$^3$ | 0.5251 | 0.5462 | 0.723 | |
| Tensile Strength at Yield (MD) | psi | 784 | 3429 | 969 | ASTM D882 |
| Tensile Strength at Yield (TD) | psi | 1089 | N/A | 763 | ASTM D882 |
| Tensile Strength at break (MD) | psi | 3003 | 5860 | 1800 | ASTM D882 |
| Tensile Strength at break (TD) | psi | 2683 | 3650 | 1400 | ASTM D882 |
| Tensile Elongation at Break (MD) | % | 631 | 290 | 600 | ASTM D882 |
| Tensile Elongation at Break (TD) | % | 1027 | 590 | 295 | ASTM D882 |
| Tear Strength (MD) | grams/mil | 62.8 | 5.8 | 160 | ASTM D1922 |
| Tear Strength (TD) | grams/mil | 220.5 | 265.3 | 172 | ASTM D1922 |
| Dart Impact | grams/mil | 326.9 | <250 | NA | ASTM D1709 |

TABLE 1B-continued

U.S. Customary/Imperial Units

| Composition | Example 1 Combination | | PE | Vinyl | Test |
|---|---|---|---|---|---|
| Test Item | Unit | Value | glove | Glove | Method |
| Seal Temperature | ° C. | 80-90 | 125-130 | NA | |

Example 2

Thermoplastic Elastomer of the Invention

A thermoplastic elastomer according to the present invention was prepared comprising the following components and concentrations in wt. %:

40 wt. % ethylene-vinyl acetate copolymer (EVA, TAISOX® available from Formosa Plastics Corporation, Polyolefin Divisions);

40 wt. % metallocene-linear low density polyethylene (m-LLDPE, AFFINITY PL 1880G available from The Dow Chemical Company);

10 wt. % slip additive (oleamide); and 10 wt. % antiblock additive (talc)

The above-described components were blended and extruded as a thin film, folded, heat sealed, and cut into a disposable glove. The disposable glove prepared from the above-described combination was subjected to various standard tests and compared to a glove made from a combination of linear low density polyethylene and high density polyethylene and a vinyl glove. The results of those tests are shown below in Tables 2A (International System Units) and 2B (US Customary/Imperial Units).

TABLE 2A

International System Units

| Composition | Example 2 Combination | | PE | Vinyl | Test |
|---|---|---|---|---|---|
| Test Item | Unit | Value | glove | Glove | Method |
| Gauge (Calculated) | μm | 27.80 | 10.00 | 50.00 | |
| Density | g/cm$^3$ | 0.921 | 0.945 | 1.25 | |
| Tensile Strength at Yield (MD) | MPa | 6.1 | 23.7 | 6.7 | ASTM D882 |
| Tensile Strength at Yield (TD) | MPa | 5.8 | N/A | 5.3 | ASTM D882 |
| Tensile Strength at break (MD) | MPa | 28.2 | 40.4 | 12.4 | ASTM D882 |
| Tensile Strength at break (TD) | MPa | 23.3 | 25.2 | 9.7 | ASTM D882 |
| Tensile Elongation at Break (MD) | % | 568 | 290 | 600 | ASTM D882 |
| Tensile Elongation at Break (TD) | % | 797 | 590 | 295 | ASTM D882 |
| Tear Strength (MD) | grams/μm | 2.2 | 0.23 | 12.6 | ASTM D1922 |
| Tear Strength (TD) | grams/μm | 14.2 | 10.6 | 13.6 | ASTM D1922 |
| Dart Impact | grams/μm | 18.2 | <10 | NA | ASTM D1709 |
| Seal Temperature | ° C. | 80-90 | 125-130 | NA | |

TABLE 2B

| U.S. Customary/Imperial Units | | | | | |
|---|---|---|---|---|---|
| Composition | Example 2 Combination | | PE | Vinyl | Test |
| Test Item | Unit | Value | glove | Glove | Method |
| Gauge (Calculated) | mil | 1.1 | 0.40 | 2 | |
| Density | oz/in$^3$ | 0.5324 | 0.5462 | 0.723 | |
| Tensile Strength at Yield (MD) | psi | 880 | 3429 | 969 | ASTM D882 |
| Tensile Strength at Yield (TD) | psi | 841 | N/A | 763 | ASTM D882 |
| Tensile Strength at break (MD) | psi | 4086 | 5860 | 1800 | ASTM D882 |
| Tensile Strength at break (TD) | psi | 3373 | 3650 | 1400 | ASTM D882 |
| Tensile Elongation at Break (MD) | % | 568 | 290 | 600 | ASTM D882 |
| Tensile Elongation at Break (TD) | % | 797 | 590 | 295 | ASTM D882 |
| Tear Strength (MD) | grams/mil | 56 | 5.8 | 160 | ASTM D1922 |
| Tear Strength (TD) | grams/mil | 358.5 | 265.3 | 172 | ASTM D1922 |
| Dart Impact | grams/mil | 460 | <250 | NA | ASTM D1709 |
| Seal Temperature | ° C. | 80-90 | 125-130 | NA | |

Example 3

Thermoplastic Elastomer of the Invention

A thermoplastic elastomer according to the present invention was prepared comprising the following components and concentrations in wt. %:

45 wt. % metallocene-linear low density polyethylene (m-LLDPE, Exact™ 4049 available from ExxonMobil Chemical);

45 wt. % metallocene-linear low density polyethylene (m-LLDPE, AFFINITY PL 1880G available from The Dow Chemical Company);

5 wt. % slip additive (oleamide); and 5 wt. % antiblock additive (synthetic silica or Talc)

The above-described components were blended and extruded as a thin film, folded, heat sealed, and cut into a disposable glove. The disposable glove prepared from the above-described combination was subjected to various standard tests and compared to a glove made from a combination of linear low density polyethylene and high density polyethylene and a vinyl glove. The results of those tests are shown below in Tables 3A (International System Units) and 3B (US Customary/Imperial Units).

TABLE 3A

| International System Units | | | | | |
|---|---|---|---|---|---|
| Composition | Example 3 Combination | | PE | Vinyl | Test |
| Test Item | Unit | Value | glove | Glove | Method |
| Gauge (Calculated) | μm | 29.37 | 10.00 | 50.00 | |
| Density | g/cm$^3$ | 0.891 | 0.945 | 1.25 | |
| Tensile Strength at Yield (MD) | MPa | 4.8 | 23.7 | 6.7 | ASTM D882 |
| Tensile Strength at Yield (TD) | MPa | 4.3 | N/A | 5.3 | ASTM D882 |
| Tensile Strength at Break (MD) | MPa | 32.6 | 40.4 | 12.4 | ASTM D882 |
| Tensile Strength at Break (TD) | MPa | 31.4 | 25.2 | 9.7 | ASTM D882 |
| Tensile Elongation at Break (MD) | % | 867 | 290 | 600 | ASTM D882 |
| Tensile Elongation at Break (TD) | % | 994 | 590 | 295 | ASTM D882 |
| Tear Strength (MD) | grams/μm | 3.8 | 0.23 | 12.6 | ASTM D1922 |
| Tear Strength (TD) | grams/μm | 6.5 | 10.6 | 13.6 | ASTM D1922 |
| Dart Impact | grams/μm | >18.6 | <10 | NA | ASTM D1709 |
| Seal Temperature | ° C. | 80-90 | 125-130 | NA | |

TABLE 3B

| U.S. Customary/Imperial Units | | | | | |
|---|---|---|---|---|---|
| Composition | Example 3 Combination | | PE | Vinyl | Test |
| Test Item | Unit | Value | glove | Glove | Method |
| Gauge (Calculated) | mil | 1.16 | 0.40 | 2 | |
| Density | oz/in$^3$ | 0.5150 | 0.5462 | 0.723 | |
| Tensile Strength at Yield (MD) | psi | 689 | 3429 | 969 | ASTM D882 |
| Tensile Strength at Yield (TD) | psi | 617 | N/A | 763 | ASTM D882 |
| Tensile Strength at Break (MD) | psi | 4725 | 5860 | 1800 | ASTM D882 |
| Tensile Strength at Break (TD) | psi | 4562 | 3650 | 1400 | ASTM D882 |
| Tensile Elongation at Break (MD) | % | 867 | 290 | 600 | ASTM D882 |
| Tensile Elongation at Break (TD) | % | 994 | 590 | 295 | ASTM D882 |
| Tear Strength (MD) | grams/mil | 96.6 | 5.8 | 160 | ASTM D1922 |
| Tear Strength (TD) | grams/mil | 164.7 | 265.3 | 172 | ASTM D1922 |
| Dart Impact | grams/mil | >470 | <250 | NA | ASTM D1709 |
| Seal Temperature | ° C. | 80-90 | 125-130 | NA | |

Example 4

Thermoplastic Elastomer of the Invention

A thermoplastic elastomer according to the present invention was prepared comprising the following components and concentrations in wt. %:

25 wt. % linear low density polyethylene (LLDPE, Formolene L42009 available from Formosa Plastics Corporation);

65 wt. % metallocene-linear low density polyethylene (m-LLDPE, Exact™ 4049 available from ExxonMobil Chemical);

5 wt. % slip additive (oleamide); and 5 wt. % antiblock additive (synthetic silica or Talc)

The above-described components were blended and extruded as a thin film, folded, heat sealed, and cut into a disposable glove. The disposable glove prepared from the above-described combination was subjected to various standard tests and compared to a glove made from a combination of linear low density polyethylene and high density polyethylene and a vinyl glove. The results of those tests are shown below in Tables 4A (International System Units) and 4B (US Customary/Imperial Units).

TABLE 4A

International System Units

| Composition | | Example 4 Combination | PE | Vinyl | Test |
|---|---|---|---|---|---|
| Test Item | Unit | Value | glove | Glove | Method |
| Gauge (Calculated) | μm | 32.00 | 10.00 | 50.00 | |
| Density | g/cm$^3$ | 0.905 | 0.945 | 1.25 | |
| Tensile Strength at Yield (MD) | MPa | 3.6 | 23.7 | 6.7 | ASTM D882 |
| Tensile Strength at Yield (TD) | MPa | 3.5 | N/A | 5.3 | ASTM D882 |
| Tensile Strength at Break (MD) | MPa | 24.1 | 40.4 | 12.4 | ASTM D882 |
| Tensile Strength at Break (TD) | MPa | 25.9 | 25.2 | 9.7 | ASTM D882 |
| Tensile Elongation at Break (MD) | % | 600 | 290 | 600 | ASTM D882 |
| Tensile Elongation at Break (TD) | % | 800 | 590 | 295 | ASTM D882 |
| Tear Strength (MD) | grams/μm | 2.8 | 0.23 | 12.6 | ASTM D1922 |
| Tear Strength (TD) | grams/μm | 7.7 | 10.6 | 13.6 | ASTM D1922 |
| Dart Impact | grams/μm | 7.8 | <10 | NA | ASTM D1709 |
| Seal Temperature | ° C. | 80-90 | 125-130 | NA | |

TABLE 4A

U.S. Customary/Imperial Units

| Composition | | Example 4 Combination | PE | Vinyl | Test |
|---|---|---|---|---|---|
| Test Item | Unit | Value | glove | Glove | Method |
| Gauge (Calculated) | mil | 1.26 | 0.40 | 2 | |
| Density | oz/in$^3$ | 0.5231 | 0.5462 | 0.723 | |
| Tensile Strength at Yield (MD) | psi | 520 | 3429 | 969 | ASTM D882 |
| Tensile Strength at Yield (TD) | psi | 507 | N/A | 763 | ASTM D882 |

TABLE 4A-continued

U.S. Customary/Imperial Units

| Composition | | Example 4 Combination | PE | Vinyl | Test |
|---|---|---|---|---|---|
| Test Item | Unit | Value | glove | Glove | Method |
| Tensile Strength at Break (MD) | psi | 3486 | 5860 | 1800 | ASTM D882 |
| Tensile Strength at Break (TD) | psi | 3750 | 3650 | 1400 | ASTM D882 |
| Tensile Elongation at Break (MD) | % | 600 | 290 | 600 | ASTM D882 |
| Tensile Elongation at Break (TD) | % | 800 | 590 | 295 | ASTM D882 |
| Tear Strength (MD) | grams/mil | 71.4 | 5.8 | 160 | ASTM D1922 |
| Tear Strength (TD) | grams/mil | 194.4 | 265.3 | 172 | ASTM D1922 |
| Dart Impact | grams/mil | 198.4 | <250 | NA | ASTM D1709 |
| Seal Temperature | ° C. | 80-90 | 125-130 | NA | |

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. A disposable glove comprising:

a glove construction material in the shape of a glove and adapted for receiving thumb, fingers and a hand therein, and constructed from two films of thermoplastic material, each film comprising a blend of thermoplastic material comprising two or more ethylene-based polymers comprising:

(i) a first metallocene-linear low density polyethylene (m-LLDPE), and (ii) at least one ethylene-based polymer selected from the group consisting of a second metallocene-linear low density polyethylene (m-LLDPE), an ethylene-vinyl acetate copolymer (EVA), a linear low density polyethylene (LLDPE), and combinations thereof;

wherein the thermoplastic material is characterized by tensile strength at yield (MD) of no more than 14 MPa (2000 psi), tensile strength at yield (TD) of no more than 14 MPa (2000 psi), tensile elongation at break (MD) of at least 500%, and tensile elongation at break (TD) of at least 700%; and the thermoplastic material has a tear strength (MD) of at least 1.6 g/μm and a seal temperature of less than 100° C.

2. The glove of claim 1 wherein the thermoplastic material comprises the first metallocene-linear low density polyethylene (m-LLDPE) and the ethylene-vinyl acetate copolymer (EVA).

3. The glove of claim 1 wherein the thermoplastic material consists essentially of between 30 weight % and 70 weight % of the first m-LLDPE and between 30 weight % and 70 weight % of the EVA copolymer, and additional components selected from the group consisting of anti-block additives, slip additives, UV inhibitors, colorants, fillers, and combinations thereof.

4. The glove of claim 1 wherein the thermoplastic material comprises the first metallocene-linear low density polyethylene (m-LLDPE) and the linear low density polyethylene (LLDPE).

5. The glove of claim 1 wherein the thermoplastic material consists essentially of between 35 weight % and 65 weight % of the m-LLDPE and between 15 weight % and 45 weight % of the LLDPE, and additional components selected from the group consisting of anti-block additives, slip additives, UV inhibitors, colorants, fillers, and combinations thereof.

6. The glove of claim 5 wherein the first metallocene-linear low density polyethylene (m-LLDPE) has tensile elongation (MD) at break of at least 400% and tensile elongation (TD) at break of at least 400%.

7. The glove of claim 1 wherein the thermoplastic material comprises the first metallocene-linear low density polyethylene (m-LLDPE) and the second metallocene-linear low density polyethylene (m-LLDPE).

8. The glove of claim 1 wherein the thermoplastic material consists essentially of between 30 weight % and 55 weight % of the first m-LLDPE and between 30 weight % and 55 weight % of the second m-LLDPE, and additional components selected from the group consisting of anti-block additives, slip additives, UV inhibitors, colorants, fillers, and combinations thereof.

9. The glove of claim 1 wherein the thermoplastic material comprises the metallocene-linear low density polyethylene (m-LLDPE), the ethylene-vinyl acetate copolymer (EVA), and the linear low density polyethylene (LLDPE).

10. The glove of claim 1 wherein the thermoplastic material consists essentially of between 30 weight % and 50 weight % of the EVA copolymer, between 10 weight % and 30 weight % of the LLDPE, between 30 weight % and 50 weight % of the m-LLDPE, and additional components selected from the group consisting of anti-block additives, slip additives, UV inhibitors, colorants, fillers, and combinations thereof.

11. The glove of claim 10 wherein the thermoplastic material has a tensile strength at yield (TD) of between 4.2 MPa (610 psi) and 13.8 MPa (2000 psi).

12. The glove of claim 1 wherein the first metallocene-linear low density polyethylene (m-LLDPE) has a density no greater than 0.9 g/cm$^3$.

13. The glove of claim 1 wherein the first metallocene-linear low density polyethylene (m-LLDPE) has a density no greater than 0.9 g/cm$^3$, a tensile strength at yield (MD) of no more than 14 MPa (2000 psi) and a tensile strength at yield (TD) of no more than 14 MPa (2000 psi).

14. The glove of claim 1 wherein the first metallocene-linear low density polyethylene (m-LLDPE) has tensile elongation (MD) at break of at least 400% and tensile elongation (TD) at break of at least 400%.

15. The glove of claim 1 wherein the thermoplastic material has a thickness of at least 12 micrometers (at least 0.5 mil).

16. The glove of claim 1 wherein the thermoplastic material has a tensile strength at yield (MD) of no more than 10 MPa (1450 psi).

17. The glove of claim 16 wherein the thermoplastic material has a tensile strength at yield (TD) of no more than 10 MPa (1450 psi).

18. The glove of claim 1 wherein the thermoplastic material has a tensile strength at yield (MD) of between 4.2 MPa (610 psi) and 13.8 MPa (2000 psi).

19. The glove of claim 1 wherein the thermoplastic material has a tensile strength at yield (TD) of between 4.2 MPa (610 psi) and 13.8 MPa (2000 psi).

20. The glove of claim 1 wherein the thermoplastic material has a tensile elongation at break (MD) of at least 700%.

* * * * *